United States Patent [19]

Joshi et al.

[11] 4,225,985

[45] * Oct. 7, 1980

[54] VALVED VOLUME DIVIDING MEANS

[76] Inventors: Devendra C. Joshi, 1066 Oak St., Neenah, Wis. 54956; Virendra N. Sharma, 1400 Linda Ave., Menasha, Wis. 54952

[ * ] Notice: The portion of the term of this patent subsequent to Mar. 13, 1996, has been disclaimed.

[21] Appl. No.: 8,834

[22] Filed: Feb. 2, 1979

Related U.S. Application Data

[63] Continuation of Ser. No. 816,900, Jul. 18, 1977, Pat. No. 4,143,430.

[51] Int. Cl.[3] ..... E03D 1/14; E03D 3/12

[52] U.S. Cl. ..... 4/324; 4/346; 4/364; 4/415

[58] Field of Search ..... 4/324, 346, 364, 415, 4/326

[56] References Cited

U.S. PATENT DOCUMENTS

| | | | |
|---|---|---|---|
| 390,204 | 10/1888 | Clark et al. | 4/346 |
| 2,864,095 | 12/1958 | Martino | 4/326 |
| 3,041,630 | 7/1962 | Williams | 4/326 |
| 3,375,531 | 4/1968 | Lake | 4/326 |
| 3,444,439 | 10/1967 | Davies | 4/326 |
| 4,000,526 | 1/1977 | Biela et al. | 4/325 |
| 4,044,407 | 8/1977 | Silcox | 4/364 |

*Primary Examiner*—Lenard A. Footland
*Attorney, Agent, or Firm*—Russell L. Johnson

[57] ABSTRACT

This invention relates to water conserving devices to be used in the water closets of bathroom toilets. The devices may also find applications in other liquid containing and discharging vessels. The invention consists of a partition wall or alternatively a minitank installable in the water closet of a toilet so as to divide the water closet into two separate liquid holding compartments. A flapper valve with a magnetic closure, fitted into the partition wall or into the minitank, opens and closes a port which communicates between the compartments. The actuating means of the flapper valve is operably connected to the existing trip lever of the water closet in such a way that the valve will be actuated only after the existing discharge valve has been actuated first. This arrangement permits the user to discharge water from one or both compartments of the water closet according to his needs. In the preferred embodiments, the devices are installable by anyone possessing only the skills and tools commonly found in an ordinary household.

6 Claims, 14 Drawing Figures

VALVED VOLUME DIVIDING MEANS

HISTORY OF THE INVENTION

This Application is a continuation application of our parent application titled VALVED VOLUME DIVIDING MEANS having Ser. No. 816,900, filed July 18, 1977, now U.S. Pat. No. 4,143,430.

The concept of selecting the amount of water to flush a toilet according to the nature and the quantity of the materials to be flushed is not new. For instance, C. W. Brown in U.S. Pat. No. 1,805,204 issued to him in 1931 proposes a "Closet Flushing Device" wherein the tank is divided into two unequal compartments. The user, as a result, is provided with the option of three flushing volumes; namely the volume of the small compartment or of the larger compartment, or of both compartments together.

The Brown Patent is interesting, further, in the sense that the in-tank mechanisms illustrated by him and of course used eariler are functionally identical to, and physically nearly identical to, the in-tank mechanisms employed today in the overwhelming majority of toilet tanks.

Considerable amount of effort has been invested by different people, as the large number of patents issued over the years indicates, to bring the concepts exemplified by Brown into the general usage. However, their efforts have met with limited success at best. For the most part, the devices and means proposed in the prior art appear to be able to perform their intended functions satisfactorily. Yet, none of these patented inventions has made any significant impact on the industry. Toilets, water closets, toilet in-take mechanisms and flush actuators are essentially the same today as they were several decades ago. The following sets forth some of the inadequacies of the prior art devices and explains why they have not made any commercial impact.

First, the prior art devices generally do not employ the existing in-tank mechanisms, as such. To employ these devices the in-tank mechanisms, or the flush actuating means have to be replaced or modified significantly. Secondly, a large proportion of the prior art devices are cumbersome and therefore, they either have to be incorporated in the original equipment at the factory, or require the services of a skilled craftsman, if installed in the existing toilets of a home. Thirdly, the prior art devices frequently require a change of user habits in manipulating the flushing mechanism. Fourth, a number of devices in the prior art utilize an additional discharge valve connected to the main discharge column of a toilet. But in doing so they introduce an extra risk of water leakage by way of the second discharge valve. The loss of water due to valve leakage is considered a major problem of the toilet tanks. The following examples will serve to illustrate the above points.

U.S. Pat. No. 3,344,439 to Davies, involves the insertion of a box-like compartment in the water closet and utilizes a counter balanced flapper valve, both of which require modification or replacement of the flush actuating means. The so called "double-flush" proposals such as U.S. Pat. No. 3,795,016 to Eastman and U.S. Pat. No. 3,380,077 to Armstrong, also suffer from one or more of the shortcomings listed above.

Therefore, it is the objects of this invention to provide a multiple flush volume means which, 1. requires no modifications or replacements of the tank or its inside mechanisms.
2. does not introduce any additional risk of water loss due to a valve leakage.
3. requires no specialized skills or tools for its installation.
4. is simple and economical in structure.
5. resists corrosion and functions reliably in the presence of in-tank incrustations common in many parts of the country.
6. requires a minimum change of habit or adaption for the user.
7. may be installed and removed from existing toilet tanks without disturbing the in-tank mechanisms significantly.

BRIEF DESCRIPTION OF THE INVENTION

The invention is a device which when installed in a tank permits an operator to selectively discharge various volumes of liquid from the tank. Specifically, it is a valved tank dividing means which is operably connected to the trip lever of a water closet so as to permit the user to discharge a part or the full tank volume of water to the toilet bowl. This is done by rotating the flush handle in the usual manner either partially or fully.

The invention is comprised of four principle units;

1. the 'compartmentalizing unit' by means of which the toilet tank is divided into two or more separate volumes.
2. a 'valve unit' to permit the liquid to flow from one compartment to the other.
3. an 'adjustment means' whereby the angle of rotation of the trip lever between the first and the second valve actuation is adjusted.
4. an 'actuator linking unit' by means of which an 'adjustment lever' is operably connected to the existing trip lever of the tank.

The 'compartmentalizing unit' may be a bulkhead or divider wall which is expanded against the sides of the water closet and sealed therewith by soft gasketing material. Alternatively, the compartmentalizing unit may be a tank or a container which is placed within the water closet. In either instance, the compartmentalizing unit is designed to permit water to enter the second compartment, once the water in the first compartment reaches a predetermined level.

The 'valve unit' is preferably a flapper type valve. It is located in the wall of the vertical compartmentalizing unit or may be at the bottom of the tank unit. In the preferred embodiment, a flapper valve is employed having a magnetic closure and a floatation means.

The 'adjustment means' which is located above the flapper valve is connected with the valve with a flexible linkage. The adjustment means provides a means of adjusting the angle of rotation of the trip lever within the available free space in the tank. It may also provide an adjustment for the 'feel' of the opening of the flapper valve. In the preferred embodiment the adjustment means comprises a small strip of an appropriate length with a series of holes along its length. It is hinged to the divider wall or to one of the vertical walls of the tank unit. Alternatively the adjustment means may be a series of split tubes of various lengths which snap over the stem of the flush valve so as to reduce the degree of flush handle rotation required to open the toilet flush valve. It should be understood that both adjustment means may be employed advantageously in the same installation.

The 'actuator linkage' unit provides a connection between the existing trip lever of the water closet and the valve. In the preferred embodiment, an extension arm is secured to the end of the existing trip lever. This is further connected to the adjustment lever with an adjustable linkage. The adjustment lever is also connected to the valve means by way of a flexible linkage.

DETAILED DESCRIPTION OF THE INVENTION

Hereinafter, like terms and like numbers will refer to like objects.

Figure 1:
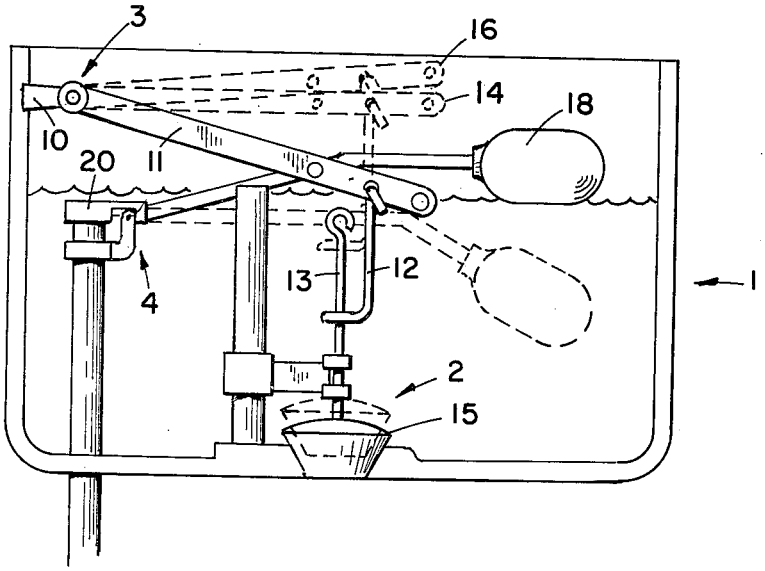
FIG. 1 is a schematic elevational view of the in-tank flush mechanisms of a conventional toilet tank.
Figure 2:
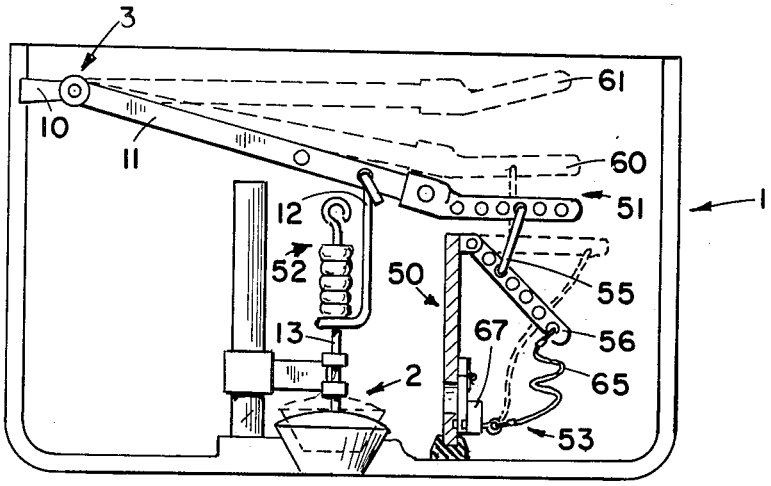
FIG. 2 is a schematic elevational view similar to that of FIG. 1 showing the units of a preferred embodiment of the invention in place.
Figure 3:
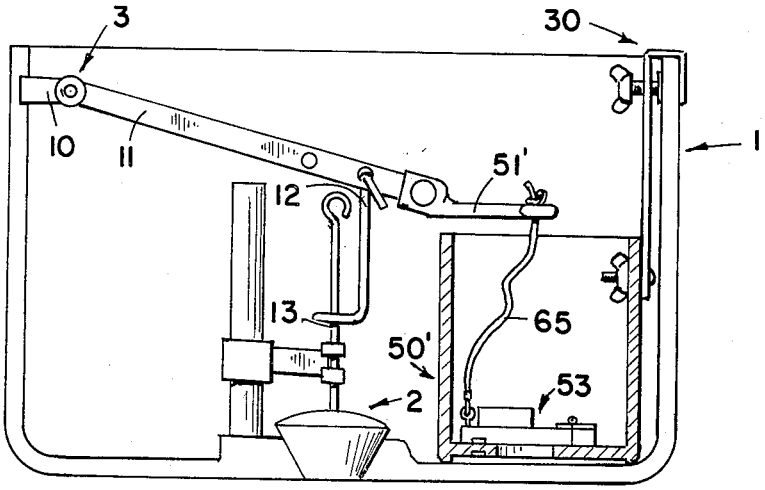
FIG. 3 is a schematic elevational view similar to that of FIG. 1 showing the elements of another preferred embodiment of the invention in place.

Referring now to FIGS. 1 through 3. The in-tank elements are shown here in schematic representation for the sake of clarity. The general components of tank 1 are flush valve 2, flush valve actuating mechanism 3 and float valve 4.

Referring now to FIG. 1. The sequence of events which occur when the toilet is flushed are as follows: Trip lever 10 is rotated downward causing flush arm 11 to rotate upward. Flush arm 11 carries with it valve linkage 12 which rises until it engages valve stem 13. Flush arm 11 is now in the position 14 which is outlined in dashed lines. Continued rotation of flush arm 11 causes stopper 15 to raise and permit the water in tank 1 to exit through valve 2 and flush the toilet. Flush arm 11 generally continues to rotate to the upper limit of its travel which is shown as upper position 16 in dashed lines. Trip lever 10 is then released to permit flush arm 11 and valve linkage 12 to return to their original position. As water flows out of tank 1, float 18 of float valve 4 descends with the level of the water in tank 1 until it opens water intake valve 20 which admits water into tank 1 at a rate slower than water flowing out of tank 1 through flush valve 2. When the water in tank 1 drops to a low enough level, stopper 15 which was buoyed up by the water, seats to close flush valve 2 and tank 1 begins to refill with water. As the water level in tank 1 approaches the full level float 18 rises and thereby closes intake valve 20 which terminates the influx of water into tank 1 and the flush cycle is completed.

Referring now to FIGS. 2 and 3. Two embodiments of the device of this invention are shown in schematic representation. In FIG. 2 a bulkhead or divider wall type of compartmentalizing unit 50 is illustrated while in FIG. 3 an insert tank type of compartmentalizing unit 50' is illustrated. Valve actuator adapter unit 52 is shown in place surrounding valve stem 13. Actuator linkage unit 51 is shown attached to flush arm 11 and joined to valve unit 53 as shown. Units 50, 51', 51, 52, 53 will be discussed in detail hereinafter.

Referring now specifically to FIG. 2. Trip lever 10 is rotated downward rotating flush arm 11 upward until flush valve linkage 12 brings adapter unit 52 into contact with valve stem 13 at a point where flush arm 11 has rotated a very short distance. Continued rotation of trip lever 10 will cause valve 2 to open as described above. If the flush handle 10 is released after opening valve 2 the water in tank 1 minus the water retained by compartmentalizing unit 50 will be free to exit tank 1 as described above permitting a partial discharge of tank 1.

However, if rotation of flush handle 10 is continued to a location 60 shown dashed, linkage unit 51 draws cord 65 taut. Continued rotation of trip lever 10 will cause flush arm 11 to be rotated to position 61 shown dashed and thereby, cause linkage unit 51 acting through connector 55 to raise adapter arm 56 which creates a tension in cord 65, to open valve unit 53. Floatation means 67 serves to maintain valve unit 53 in the open position until water has drained out of the volume contained by compartmentalizing units 50 thereby permitting a full discharge of tank 1.

It should be noted that an operator without knowledge that the device of this invention was located in the toilet tank would rotate trip lever 10 fully and affect a full discharge of tank 1 as would be normal. A knowledgable operator could at his option use a partial discharge to flush liquids or to do light disposal work when flushing away a facial tissue or the like.

Referring now to FIG. 3. Tank type compartmentalizing unit 50' is here shown to have valve unit 53 positioned at the bottom of the tank. Cord 65 joins valve unit 53 to flush arm 11 by way of linkage unit 51'. Tank type compartmentalizing unit 50' is shown to be secured to the top of toilet tank 1 by a conventional clamping arrangement 30. Clamping arrangement 30 is provided for the purpose of securing tank type compartmentalizing unit 50' against the buoyant forces exerted upon it during the period that compartmentalizing unit 50' is empty and tank 1 is filling with water. As tank 1 becomes completely filled water will flow over the top of compartmentalizing unit 50' and thereby bring the pressures inside and outside compartmentalizing unit 50' to equilibrium.

Figure 4:
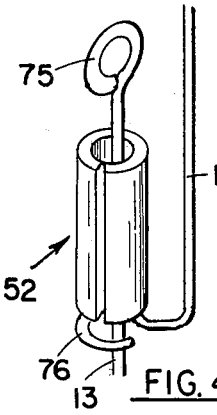
FIG. 4 is a pictorial view of valve actuator adaptor of this invention.
Figure 5:
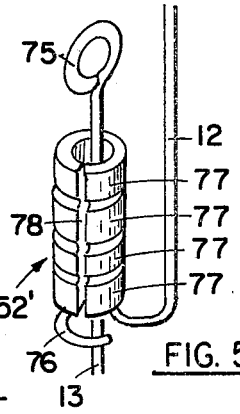
FIG. 5 is a pictorial view of another valve actuator adaptor of this invention.

Referring now to FIGS. 4 and 5. Valve actuator adapter 52 and 52' are shown to encompass valve stem 13 below stem ring 75 and above linkage ring 76 of valve linkage 12. Adapter 52 and 52' are substantially cylinders through which stem 13 may freely slide. The raising of linkage 12 causes ring 76 to raise towards ring 75. The engaging of ring 76 with ring 75 ordinarily precedes the raising of stem 13 which opens the toilet valve 2. The interposing of adapter 52 or 52' between rings 75 and 76 causes the raising of valve stem 13 when ring 76 is lower than ring 75 by a distance equal to the height of adapter 52 or 52'. The employment of adapter 52 or 52' enables the user to adjust the amount of vertical travel required before linkage 12 causes stem 13 to be raised.

Adapter 52 of FIG. 4 is shown as a split tube type of adapter which may be snapped onto stem 13 as shown without the need for any tools and without the need for disturbing the existing mechanisms. If it is desired to change the length of adapter 52 it may be removed from stem 13 and a suitable length of adapter cut off.

Adapter 52' is shown as a cylinder having scored segments 77 and a longitudinal slot 78. The length of adapter 52' may be reduced by removing one or more scored segments 77 from adapter 52'.

Figure 6:
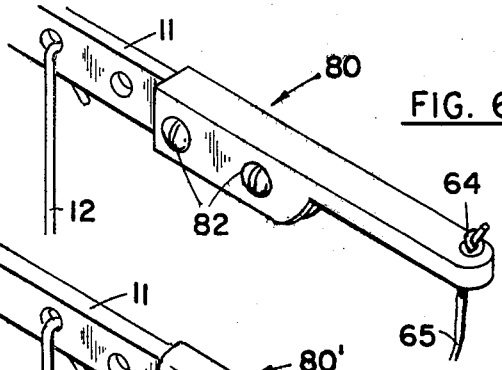
FIG. 6 is a pictorial view of an actuator linkage unit of this invention which is secured to the flush arm by threaded means.
Figure 8:
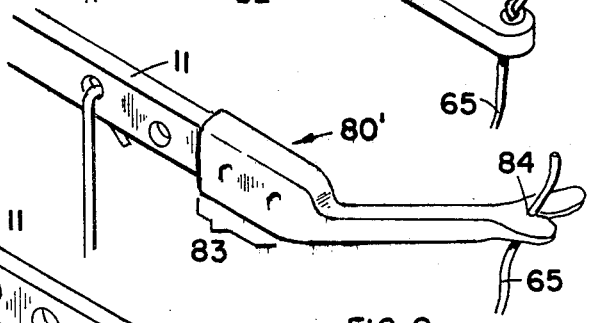
FIG. 8 is a pictorial view of an alternative means of linking the valve unit of this invention to the existing flush arm.
Figure 7:
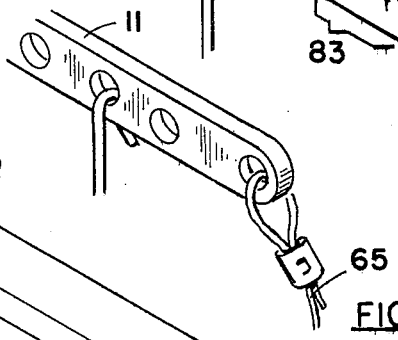
FIG. 7 is a pictorial view of an actuator linkage unit whereby the connecting cord is coupled directly to the flush arm.

Referring now to FIGS. 6, 7, and 8 which show actuator linkages of this invention which may be secured to flush arm 11 without disturbing any of the in-tank mechanisms.

Referring now to FIG. 6. Actuator linkage 80 is secured to flush arm 11 by means of screws 82 or similar means passing through holes in flush arm 11. The holes in flush arm 11 are provided as alternate locations for the positioning of valve linkage 12. Cord 65 may be secured to actuator linkage 80 by means of knot 64 as shown so as to engage actuator linkage 80 when flush arm 11 is rotated upward.

Referring now to FIG. 7. The valve unit of this invention may be operably linked to flush arm 11 by means of cord 65 being secured directly to flush arm 11 substantially as shown. Although the linkage shown in FIG. 7 is operable, it is not preferred in that the direct connection of cord 65 to flush arm 11 does not ordinarily provide the best mechanical arrangement for actuating the valve unit.

Referring now to FIG. 8. Actuator linkage 80' may be frictionally engaged with flush arm 11 by means of sleeve 83 which may be of rubber or plastic or other such resilient material which will provide a secure frictional engagement of actuator linkage 80' with flush arm 11. Cord 65 may be snapped into clevis 84 as shown.

Referring now to FIGS. 9, 10, 11, and 12. Compartmentalizing unit 50 serves to divide the tank into two separate liquid holding compartments, reserve compartment 91 and main compartment 92. Port 93 provides a passage through which liquid may pass from reserve compartment 91 into main compartment 92. Port 93 is opened and closed by means of valve unit 53 which will be discussed in detail hereinafter.

Figure 9:
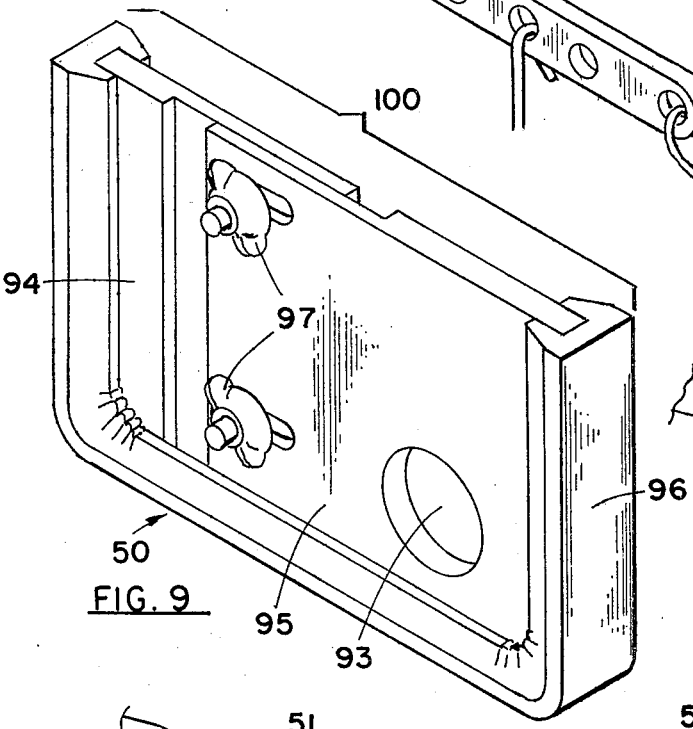
FIG. 9 is a pictorial view of a compartmentalizing unit of this invention.

Referring now to FIG. 9. Compartmentalizing unit 50 comprises an adjustable bulkhead 100 formed of two movable segments, first segment 94 and second segment 95, a flexible gasket 96 and fastening means 97. Bulkhead 100 is installed by placing bulkhead 100 in toilet tank 1 (not shown) in the desired position and adjusting bulkhead 100 so that it presses gasket 96 against the sides and bottom of tank 1. Fastening means 97 are then secured to hold bulkhead 100 in position.

Two points should be noted. The first being that the seal afforded by gasket 96 between bulkhead 100 and tank 1 need not be 100% effective in order that the device of this invention perform its intended function satisfactorily. A small amount of leakage between reserve compartment 91 and main compartment 92 can be tolerated without any adverse affect on the performance of the unit. The second point being that leakage around bulkhead 100 or through valve unit 53 will not result in water loss from tank 1 which is in counter distinction to what is the case with many prior art devices.

Figure 10:
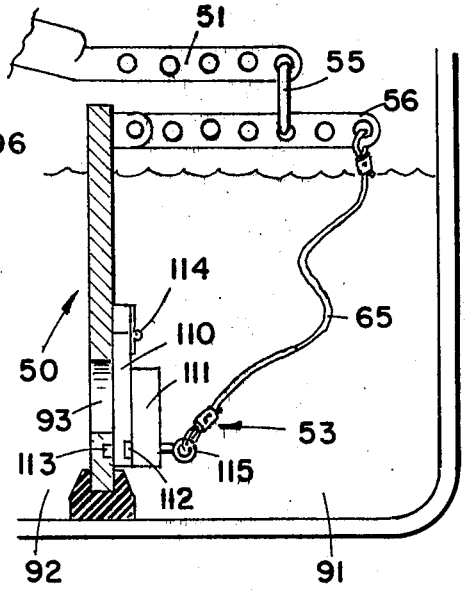
FIG. 10 is a sectioned elevational view of the compartmentalizing unit installed in a toilet tank and having the valve closed.
Figure 11:
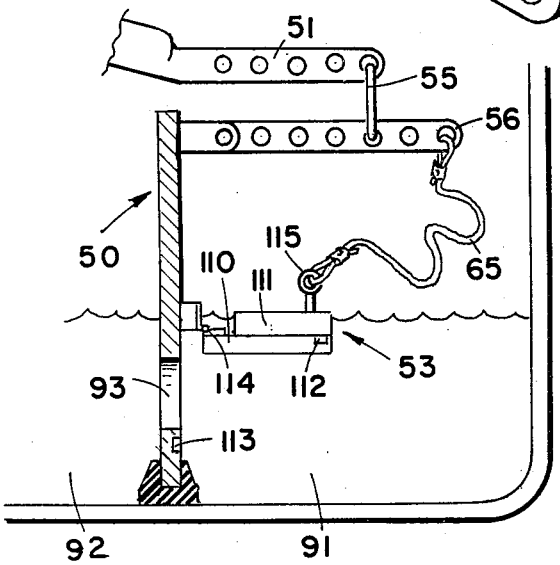
FIG. 11 is a sectioned view similar to that of FIG. 10 with the valve open.
Figure 12:
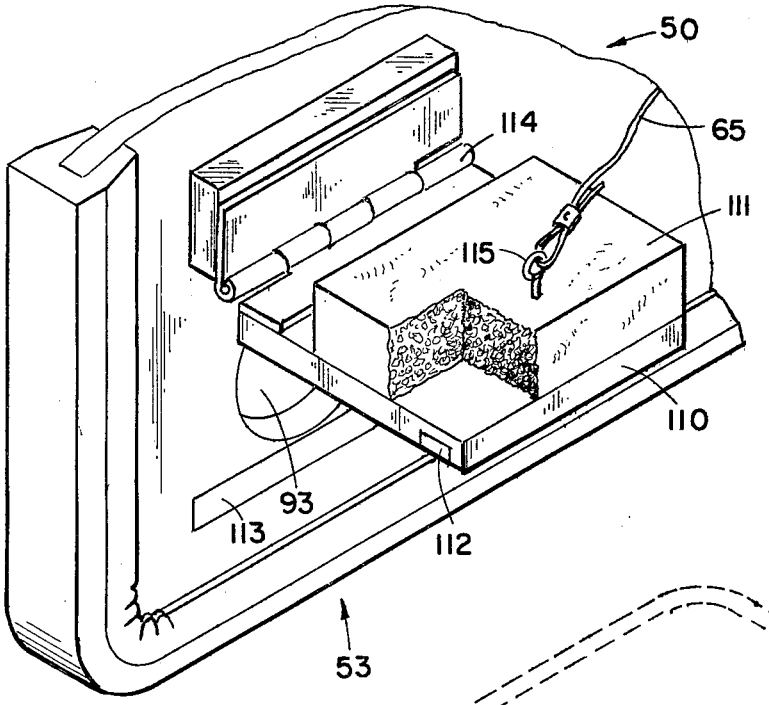
FIG. 12 is a fragmentic pictorial view of the valve unit.

Referring now to FIGS. 10, 11, and 12. Valve unit 53 serves to open and close port 93. Valve unit 53 comprises a flapper 110, a float means 111 which may be any buoyant means and is here shown as a styrofoam block attached to flapper 110 a first magnetic member 112 and a second magnetic member 113 with first magnetic member 112 being a part of flapper and second magnetic member 113 being a part of the compartmentalizing unit, a flapper guide means here shown as being 114 and a cord attachment means here shown as eye 115.

Referring now to FIGS. 10 and 11. Valve means 53 is maintained in a closed position primarily by the magnetic attraction between first magnetic member 112 and second magnetic member 113. When flush arm 11 acting through linkage unit 51 by way of adapter arm 56 and connector 55 causes tension in cord 65, flapper 110 is caused to rotate on hinge 114 and open port 93 to permit water to exit reserve compartment 91. The buoyancy of float 111 exceeds the magnetic attraction between first magnetic member 112 and second magnetic member 113 once the two members are drawn apart from each other a short distance. As the water level in reserve compartment 91 drops, float 111 permits flapper 110 to drop until the magnetic attraction between first magnetic member 112 and second magnetic member 113 draws flapper 110 against bulkhead 100 thereby closing port 93 and to complete the cycle.

Figure 13:
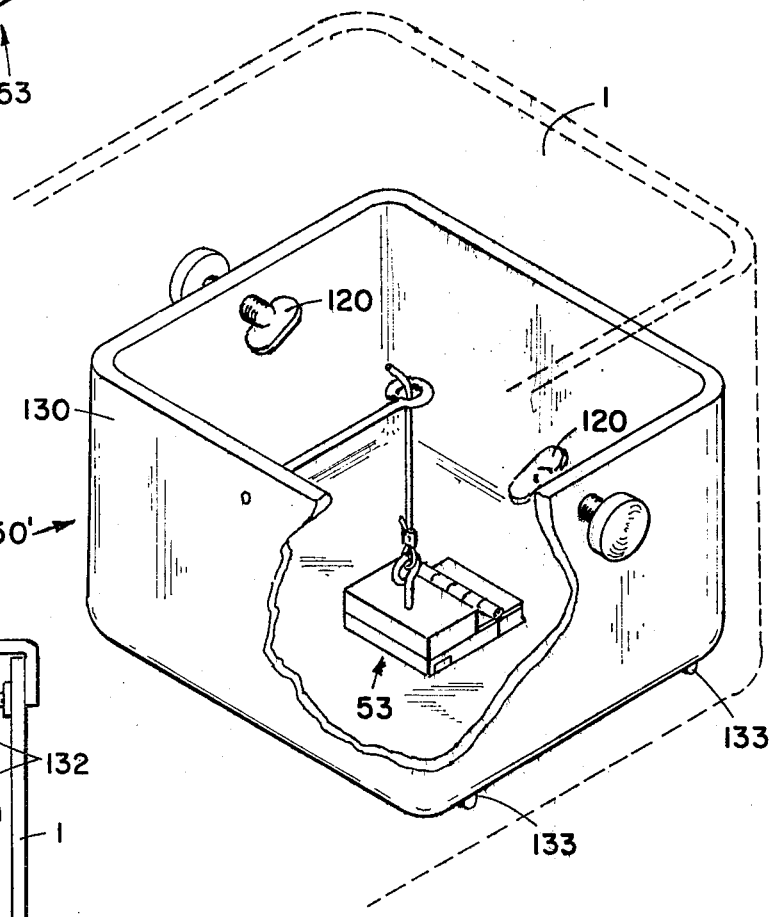
FIG. 13 is a pictorial view of another compartmentalizing unit of this invention.

Referring now to FIG. 13. Compartmentalizing unit 50' comprises a minitank 130 which is secured to tank 1 by means of screw clamps 120 and supported above the bottom of tank 1 by feet 133. Screw clamps 120 serve to frictionally engage compartmentalizing unit 50' with toilet tank. Minitank 130 may thereby be quickly and conveniently installed and secured in tank 1. The operation of compartmentalizing unit 50' is substantially as described in conjunction with FIGS. 9 through 12.

Figure 14:
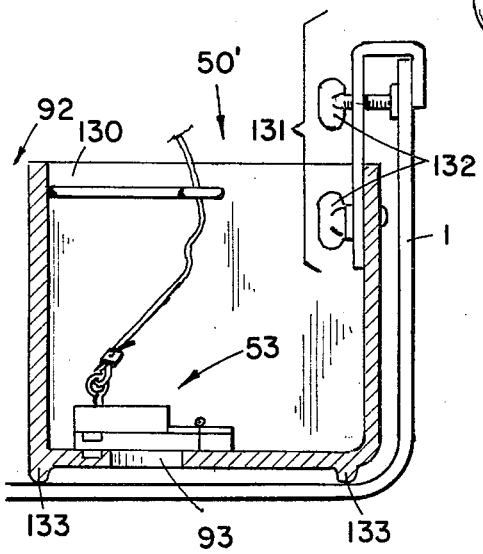
FIG. 14 is a sectioned elevational view of a device similar to that of FIG. 13 with alternative tank securing means.

Referring now to FIG. 14. Compartmentalizing unit 50' comprises a minitank 130 which may be secured to tank 1 by means of adjustable clamps 131 which are secured by fastening means 132 and supported above the bottom of tank 1 by feet 133. Valve unit 53 and port 93 are located at the bottom surface of minitank 130. Minitank 130 is provided with adjustable clamps 131 so as to enable minitank 130 to resist the buoyant forces which will be exerted upon it when main compartment 92 of tank 1 is filling with water after both tanks have been emptied and valve unit 53 has sealed. Feet 133 are provided to permit leveling of minitank 130 and to provide a space under minitank 130 through which water may flow out of minitank 130. The operation of valve unit 53 is similar to that discussed in conjunction with FIGS. 9 through 12.

It will become apparent to one skilled in the art that equivalent means may be provided to perform the functions of the units discussed herein. For example a conventional bulb type flush valve may replace the valve unit in compartment 50' or a spring or toggle means may replace the magnetic closure securing means of valve unit 53, or that a chain or linkage may replace cord 65 and so on.

However, the recitation of such equivalent means would cause the specifications to become prolix and to unduly multiply the drawings and claims. For that reason the preferred embodiments of the invention have been set forth in the specifications but the invention should be understood to be limited only by the appended claims and to all equivalents thereto which would become apparent to one skilled in the art.

What is claimed is:

1. A water closet discharge regulating means comprising:

(a) a minitank unit whereby a toilet tank is divided into water retaining compartments: a first compartment and a second compartment, (b) a port in the minitank unit through which water may pass between the first compartment and the second compartment, (c) a valve which serves to seal and open the port, (d) an actuator linking unit by means of which the valve is operably connected to an existing flush arm of the tank, (e) an adjustment means which is employable to set the degree of rotation of the flush arm needed for a valve opening, and (f) means for providing that the minitank unit, the actuator linkage unit, and the adjustment means are directly installable in the toilet tank without modifying or significantly disturbing the existing in-tank mechanisms and the installation of the discharge regulating means requires no specialized tools and no specialized skills.

2. The tank discharge regulating means of claim 1 wherein the valve comprises:

(a) a flapper which serves to open and close the port, (b) a first magnetic member being fixed relative to the port and a second magnetic member being part of the flapper and the magnets serve to maintain the valve in the closed position when the water inside or outside the minitank is at a maximum depth, (c) a flapper guide means, (d) a flapper float which is attached to the flapper and which serves to hold the first and second magnetic members apart when liquid is being discharged through the port, and (e) a connector by means of which the flapper valve is joined to a valve actuating means.

3. The tank discharge regulating means of claim 2 wherein the actuator linkage unit is an elongate arm which comprises:

(a) a fastening means at one end of the arm for joining the unit to the flush arm of the tank and the fastening means is securable to the flush arm without modifying or disturbing the flush arm, and (b) a connector receiving means at the other end of the arm for receiving a connector through which the motion of the flush arm is transferred to actuate a valve opening.

4. The tank discharge regulating means of claim 1 wherein the adjustment means is an adapter cylinder of readily cutable material and the cylinder has a longitudinal slit through which a stem of a conventional toilet valve may be snapped so as to permit the installation of the cylinder around the stem.

5. The tank discharge regulating means of claim 1 wherein the minitank comprises:

(a) a box-like tank having a bottom and four sides with an open top, (b) a valved port through which liquids may flow, and (c) a minitank is frictionally engaged with the walls of the water closet tank by means of at least one screw clamp.

6. A water closet tank discharge regulating means comprising;

(a) a minitank unit whereby the tank is divided into water retaining compartments; a first compartment and a second compartment, (b) a port in the minitank unit through which water may pass between the first compartment and the second compartment, (c) a valve which serves to seal and open the port, (d) an actuator linking unit by means of which the valve is operably connected to an existing flush arm of the tank, and (e) an adjustment means which is employable to set the degree of rotation of the flush arm needed for a valve opening, and wherein the minitank unit, the actuator linking unit, and the adjustment means are installable in the tank without modifying or significantly disturbing the existing in-tank mechanisms and the installation of the discharge regulating means requires no specialized tools and no specialized skills, and wherein the adjustment means comprises:

(1) an adjustment arm which is pivotably mounted to a vertical wall of the minitank and the adjustment arm is provided with a series of attachment locations spaced along the length of the adjustment arm, (2) a connector linkage which is joined at one end to a suitable actuator linkage and which is joined at the other end to an appropriate attachment means along the adjustment arm, and (3) the adjustment arm has a cord connected to one of the attachment means and the cord serves to operably join the adjustment arm to the valve.

* * * * *